US006092701A

United States Patent [19]

Waltenspuhl et al.

[11] Patent Number: 6,092,701

[45] Date of Patent: Jul. 25, 2000

[54] FIREPROOF PLATE AND A CLAMPING DEVICE FOR A SLIDING GATE AT THE OUTLET OF A VESSEL CONTAINING MOLTEN METAL

[75] Inventors: Rolf Waltenspuhl, Hünenberg, Switzerland; Hans Rothfuss, Taunusstein, Germany; Werner Keller, Steinhausen, Switzerland

[73] Assignees: Stopinc AG, Baar, Switzerland; Didier Werke AG, Wiesbaden, Germany

[21] Appl. No.: 09/242,010

[22] PCT Filed: Jul. 25, 1997

[86] PCT No.: PCT/CH97/00284

§ 371 Date: Feb. 5, 1999

§ 102(e) Date: Feb. 5, 1999

[87] PCT Pub. No.: WO98/05451

PCT Pub. Date: Feb. 12, 1998

[30] Foreign Application Priority Data

Aug. 5, 1996 [CH] Switzerland ..... 1922/96

[51] Int. Cl.[7] ..... B22D 41/08

[52] U.S. Cl. ..... 222/600; 266/236

[58] Field of Search ..... 222/591, 590, 222/597, 600; 266/236

[56] References Cited

U.S. PATENT DOCUMENTS

| | | | |
|---|---|---|---|
| 4,265,379 | 5/1981 | Meier | 222/600 |
| 4,508,324 | 4/1985 | Luhrsen et al. | 222/600 |
| 4,573,616 | 3/1986 | Shapland | 222/600 |
| 4,627,147 | 12/1986 | Kagi | 222/600 |
| 4,687,186 | 8/1987 | Francois-Noel | 222/600 |
| 4,840,296 | 6/1989 | Otsuka et al. | 222/600 |

*Primary Examiner*—Scott Kastler

*Attorney, Agent, or Firm*—Wenderoth, Lind & Ponack, L.L.P.

[57] ABSTRACT

A refractory plate for a sliding gate valve at the outlet of a vessel containing molten metal has a polygonal external shape and has a longitudinal axis, on both sides of which at least two side surfaces, disposed at an obtuse angel (γ) to one another, extend and serve as clamping surfaces of the plate in a metallic frame (11) or the like. The shorter side surfaces are arranged to extend at an angle (α) of between 20° and 50° to the longitudinal axis while the longer side surfaces are arranged to extend at an angle (β) of between 10° and 30° to the longitudinal axis. The refractory plate can thus be optimally clamped and an increased service life is thus consequently achieved.

14 Claims, 2 Drawing Sheets

FIREPROOF PLATE AND A CLAMPING DEVICE FOR A SLIDING GATE AT THE OUTLET OF A VESSEL CONTAINING MOLTEN METAL

BACKGROUND OF THE INVENTION

The invention relates to a refractory plate for a sliding gate valve.

A refractory plate, which is not surrounded by a metallic band, is provided in a sliding gate valve as disclosed in DE-C2 35 22 134. At least two opposing regions of an edge of the plate taper towards a sliding surface. These tapering edge regions are intended for engagement with a matching, bevelled surface of a clamping element. The dimensions and angles of the plate are so selected in the region of the bevelled surfaces from the sliding surface to a rear engagement surface that the clamping elements exert a force component directed not only towards the center of the plate but also towards the rear engagement surface. The plate can have a rectangular shape with rounded corners or a hexagonal shape which is constituted by two equal sided trapeziums with a common base.

This known way of clamping refractory plates in a sliding gate valve is associated with various disadvantages. On the one hand, a number of clamping elements provided for clamping the plate are tightened individually against corresponding edge regions of the plate by means of screws or the like. This results in a disproportionate amount of work in the installation process. Furthermore, satisfactory functioning of the screws and the threaded holes in the long term is not guaranteed in the extremely rough and hot operating environment. Furthermore, the refractory plates with the bevels provided in their edge regions are relatively expensive to manufacture, and the sharp plate edges caused by these bevels can easily break away, particularly on impact.

SUMMARY OF THE INVENTION

Against this background, it is the object of the present invention to provide a refractory plate of the type referred to above, but which can be easily manufactured and has such an external shape that optimum compressive stress conditions are present in the plate in the clamped and heated operational state and that an increased service life is consequently achieved. A sliding gate valve accommodating such plates should be equipped with a clamping device with which these plates may be simply and rapidly clamped.

The object is solved in accordance with the invention by the provisions of a refractory plate having a polygonal external shape and a longitudinal axis, on both sides of which extend at least two side surfaces of different length, which are arranged at an obtuse angle ($\gamma$) to one another and act as clamping surfaces of the plate in a metallic frame or the like. The shorter side surfaces are arranged to extend at an angle $\alpha$ of between 20° and 50° to the longitudinal axis, while the longer side surfaces are arranged to extend at an angle $\beta$ of between 10° and 30° to the longitudinal axis.

A clamping device is preferably provided for the clamping of the plate in the sliding gate valve and has clamping elements which, for the purpose of achieving engagement with the side surfaces of the refractory plate over their entire area, are pivotally mounted in a frame. At least two of the clamping elements are guided to be movable by a single clamping means towards the other two clamping elements.

Optimal clamping and thus an improved service life of the plate are achieved with this construction of the refractory plate in accordance with the invention and the clamping device holding the plate. The clamping of the plate is optimized by the force application produced over almost the entire length of the plate and by the pattern of lines of force acting on the plate at selected angles. Cracks produced in the plate in the operational state thus do not break up, and the sucking of air in through these cracks can be substantially prevented. As a result of the fact that the plate has no sheet metal shell, it may be fabricated economically.

BRIEF DESCRIPTION OF THE DRAWINGS

Exemplary embodiments of the invention and further advantages thereof will be explained in more detail below with reference to the drawings, in which.

DETAILED DESCRIPTION OF THE INVENTION

Figure 1:
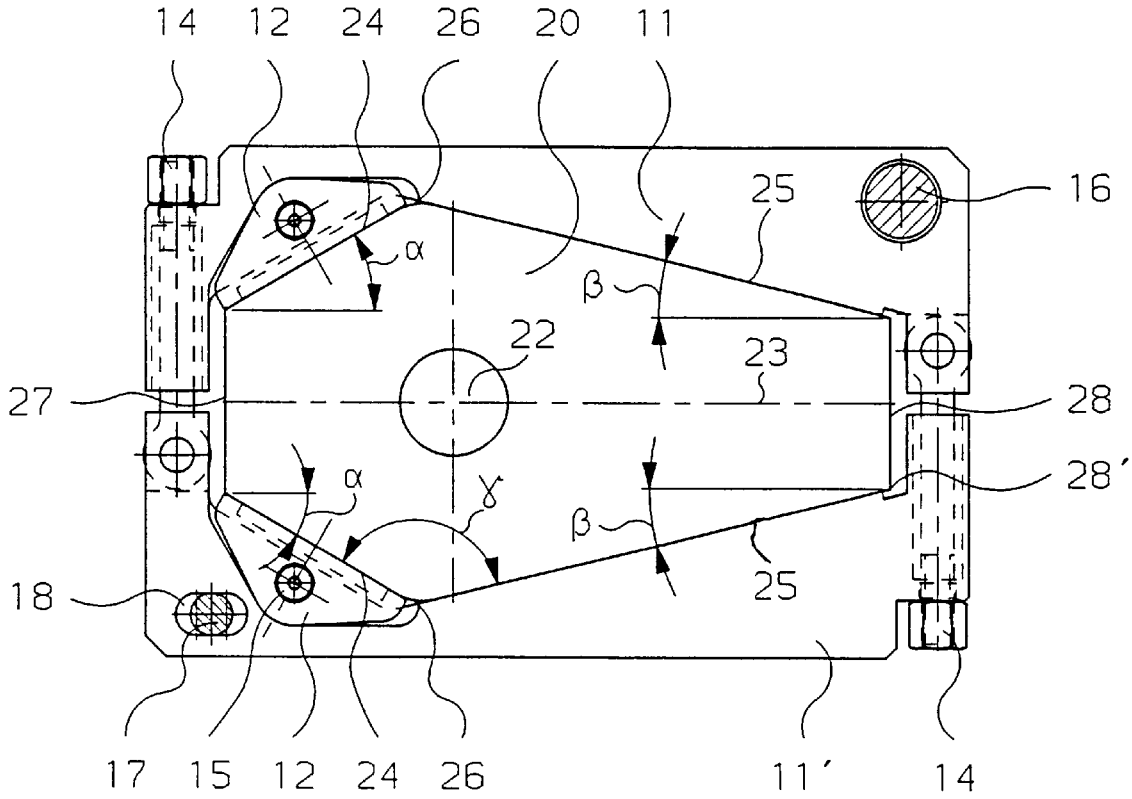
FIG. 1 is a plan view of a refractory plate in accordance with the invention mounted in a metallic frame.

FIG. 1 shows a refractory plate 20 with a flow opening 22 clamped in a metallic frame 11. This plate 20 may be inserted as a base plate or a sliding plate into a sliding gate valve, which is not shown in detail, at the outlet of a vessel containing molten metal. Such a sliding gate valve is illustrated and described in detail, for instance in the publication EP-B1 0277146. It is used, in particular, for ladles containing molten metal which are conventionally provided in continuous casting installations. The refractory plate 20 comprises heat-resistant ceramic material and it can be manufactured in one piece or from a base material with at least one high grade refractory insert, this refractory insert advantageously defining the flow opening 22 through which the molten steel flows in the operational state of the plate.

In the present exemplary embodiment the plate 20 has a hexagonal external shape with an elongate symmetrical construction. Extending on both sides of longitudinal axis 23 of the plate are two respective side surfaces 24, 25 of different length, which are disposed at an obtuse angle $\gamma$ to one another and serve as clamping surfaces for the plate 20 in the metallic frame 11. In accordance with the invention, the shorter side surfaces 24 are each arranged to extend at an angle $\alpha$ of between 20° and 50° to the longitudinal axis 23, while the longer side surfaces 25 are each arranged to extend at an angle $\beta$ of between 10° and 30° to the longitudinal axis 23. In the actual advantageous exemplary embodiment the angle $\alpha$ is approximately 30° and the angle $\beta$ is approximately 14°. The shorter and longer side surfaces 24, 25 serve as clamping surfaces for the plate 20 in the metallic frame 11 and define therebetween a transverse edge 26. Between the shorter and longer side surfaces 24 and 25, respectively, the ends of the plate is formed with respective end surfaces 27, 28 extending perpendicular to the longitudinal axis 23. These end surfaces 27, 28 have a length of approximately half the width of the plate. After clamping the plate 20 in the frame 11, end surfaces 27, 28 are not contacted and thus not clamped to the metallic frame 11.

The flow opening 22 is disposed perpendicularly on the longitudinal axis 23 and has a diameter which is about one-third to one-quarter of the breadth of the plate. Flow opening 22 is offset from the center of the plate 20 towards the shorter side surfaces 24 with respect to the longitudinal dimension of the plate. The center of opening 22 lies approximately on the angular bisector which is defined by the obtuse angle γ between the shorter and longer side surfaces 24, 25. A spacing of about one-third of the length of the plate is provided between the opening 22 and the end surface 27 which connects the two shorter side surfaces 24.

The metallic frame 11 comprises two frame portions 11' of the same dimensions, two clamping shoes 12 pivotally mounted on the latter and two threaded bolts 14 connecting the two frame portions. The threaded bolts are pivotally mounted laterally on a respective frame portion 11' and extend through a bore provided in the other frame portion 11'. The bolted together frame portions and the clamping shoes 12 define an opening which corresponds to the external shape of the plate and in which the plate 20 can be clamped. The frame 11 with the plate 20 clamped therein can be inserted into a housing of the sliding gate valve, only two centering pegs 16, 17 of which are illustrated. The one frame portion 11' has a corresponding bore to receive the peg 16 while the other frame portion conveniently has a longitudinal groove 18 in which the peg 17 is centered so that the frame can expand, at least in the longitudinal direction, in the housing as a result of the heat produced in the operational state. After the plate 20 has become worn, it can be removed together with the frame, and the frame can be reused with a new plate clamped therein.

This described construction of the frame 11 makes possible clamping of the plate therein with shorter and longer side surfaces 24, 25 respectively engaging the clamping shoes or the frame portions over nearly their entire length, particularly even if the external dimensions of the plate vary by a few millimeters due to manufacturing reasons. This can be ensured by appropriate adjustment of the threaded bolts 14. This results in a further advantage of the present invention in that side surface of the plate need not be manufactured to narrow tolerances.

Figure 2:
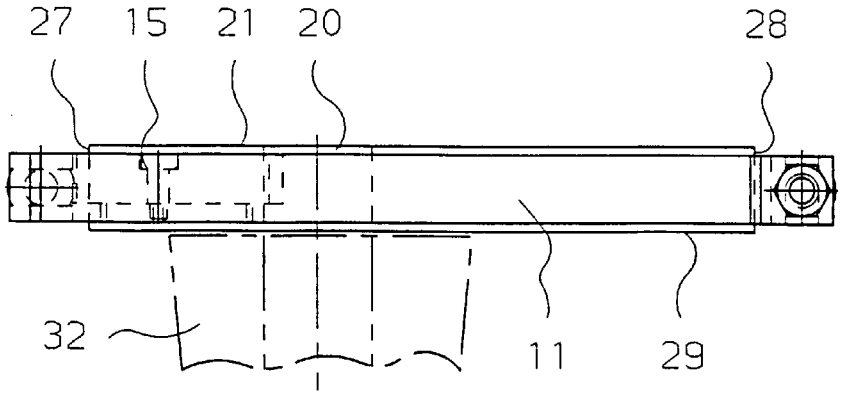
FIG. 2 is a side view of the plate of FIG. 1 mounted in the frame.

As shown in FIG. 2, the plate 2 has two plane parallel surfaces 21, 29, at least one of which is ground. The upper or lower surface 21, 29 acts as a sliding surface which is in sliding contact, in the operational state of the plate, with a similar second plate. When the one plate moves in the direction of its longitudinal axis 23, the flow openings are moved more or less into registry, in an open position, and out of registry, in a closed position. Connected to the surface 29 opposite to the sliding surface there is in general a refractory sleeve 32 which is shown in chain-dotted lines. For a satisfactory seal between the plate and this sleeve the plate can have a recess, in a manner known per se, in the region of the flow opening to accommodate the sleeve or a shoulder projecting into the sleeve.

The external shape of the plate could in principle also be defined by less or more than six corners and, for example, could be octagonal, whereby in this case the additional surfaces would advantageously be formed between the shorter and the longer side surfaces 24, 25 and arranged approximately parallel to the longitudinal axis 23. The position of the flow opening 22 with respect to the longitudinal axis 23 could also be disposed, for instance, on the connecting line between the edges 26 or in a different position.

Figure 3:
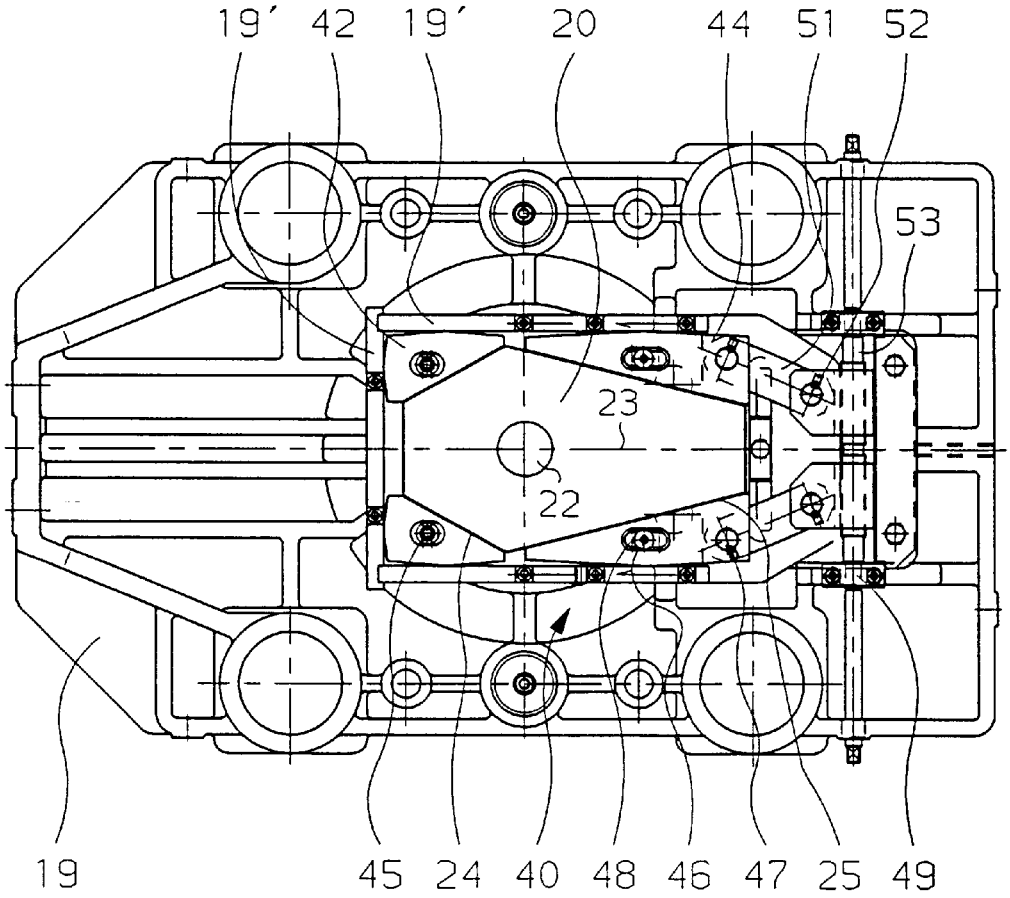
FIG. 3 is a plan view of a sliding gate valve housing with a clamping device for clamping the plate of FIG. 1.

FIG. 3 shows a clamping device 40 integrated into a slider housing 19 for releasably securing the refractory plate 20. This clamping device 40 has four clamping elements 42, 44 which are arranged in housing 19 and which afford respective clamping surfaces which are pressed, in the clamped state, against corresponding side surfaces 24, 25 of the plate 20. In accordance with the invention, these clamping elements 42, 44 are pivotally mounted in the housing 19 for the purpose of achieving engagement over their whole area with the side surfaces 24, 25 of the plate 20, and two of the clamping elements 44 are guided to be movable by a single clamping means towards the other two clamping elements 42. Each triangularly shaped clamping element 42, 44 has a clamping surface on its base side, and one or both of its rear sides is slightly dished or convex to engage abutment surfaces 19' on the housing 19. For pivotal mounting elements 42, 44 are provided with longitudinal grooves 48, which are aligned parallel with the longitudinal axis 23 and in which pegs 45, 46 projecting from housing 19 are centered in an approximately clearance-free manner. When clamping a plate 20, clamping elements 42, 44 thus adopt automatically the effective angle α or β of a side surface 24, 25 and consequently ensure engagement over their whole area, which results in uniform pressure distribution of the clamping force on the plate, which maximizes the service life of the plate.

The two movable clamping elements 44 on the longer side surfaces 25 are connected via respective levers 51 to sliding blocks 52 which are in engagement with a threaded rod 53 which is transverse to the direction of movement of the clamping elements 44 and is rotatably mounted on the housing 19. When threaded rod 53 is rotated, the two sliding blocks 52 move either inwardly or outwardly as a result of opposite-handed threads provided therein. In the event of outward movement, the clamping elements 44 are pressed by the levers 51 against the plate 20 and the plate is thus clamped, whilst in the case of inward movement the plate is released. The rotation of the threaded rod 53 can be effected by means of a manually actuated key or by means of an automatically acting device which is not shown in detail. The clamping surfaces of the clamping elements 42, 44 are so dimensioned that they overlap the side surfaces of the refractory plate and are in contact with them over almost their entire length, but advantageously have a somewhat smaller length than the corresponding side surfaces 24, 25 of the plate and, in the clamped state, engage between the ends of the side surfaces 24, 25 without contacting lateral plate edges 26, 28' in order to prevent the formation of cracks at such edges.

Figure 4:
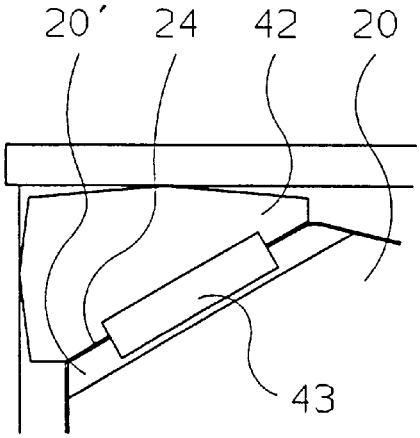
FIG. 4 is a plan view of a modified plate mounting.
Figure 5:
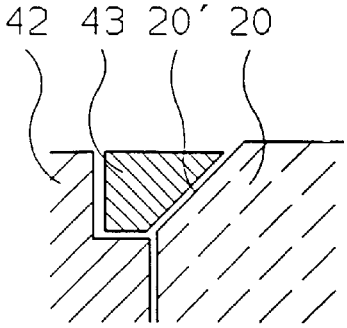
FIG. 5 is a sectional view of the plate mounting of FIG. 4.

FIG. 4 and FIG. 5 illustrate a modification of the clamping element 42 and of the plate 20 cooperating therewith. The plate 20 has a chamfer 20' which extends over the shorter side surface 24 and is intended for engagement by a retaining element 43 secured to the clamping element 42. The plate 20 is thus prevented from falling out when it is in the released state and the slider housing 19 and the plate 20 with it, viewed in the longitudinal direction, are located in a vertical installation position.

Other modifications of clamping devices may of course also be used. However, the comments set forth are sufficient to explain the invention. The plate could be surrounded on its narrow side, for instance with a band, so that it does not fall apart after use during disassembly in which the clamping elements are released. For the purpose of insulation, the plate could also be provided at this narrow side and/or at the rear side 29 with a flexible coating, e.g. a Pyrostop paper.

What is claimed is:

1. A refractory plate for use in a sliding gate valve for controlling the discharge of molten material from a vessel, said plate comprising:

a polygonal external shape and a longitudinal axis;

at least two side surfaces of different length on each side of said longitudinal axis;

said side surfaces on each side of said longitudinal axis extending at an obtuse angle γ to each other;

a shorter said side surface on each side of said longitudinal axis extending at an angle $\alpha$ of between 20° and 50° to said longitudinal axis;

a longer said side surface on each side of said longitudinal axis extending at an angle $\beta$ of between 10° and 30° to said longitudinal axis;

a first end surface extending perpendicular to said longitudinal axis and connected to said shorter side surfaces;

a second end surface extending perpendicular to said longitudinal axis and connected to said longer side surfaces;

said shorter side surfaces and said longer side surfaces comprising clamping surfaces operable to be clamped by a frame to mount said plate in the sliding gate valve; and said first end surface and said second end surface comprising unclamped surfaces operable to not be clamped by the frame.

2. A plate as claimed in claim 1, wherein said angle $\alpha$ is approximately 30° and said angle $\beta$ is approximately 15°.

3. A plate as claimed in claim 1, wherein said shape is symmetrical with respect to said longitudinal axis.

4. A plate as claimed in claim 1, wherein said shape is hexagonal.

5. A plate as claimed in claim 1, wherein at least one said side surface has a bevel.

6. A plate as claimed in claim 1, further comprising a flow opening arranged on said longitudinal axis at a location closer to said first end surface than to said second end surface.

7. A plate as claimed in claim 1, wherein said first end surface and said second end surface have substantially equal lengths.

8. A plate as claimed in claim 1, wherein said first end surface and said second end surface have lengths equal to approximately one-half of a width of said plate.

9. An assembly for use in a sliding gate valve for controlling the discharge of molten material from a vessel, said plate comprising:

a refractory plate having a polygonal external shape and a longitudinal axis, at least two side surfaces of different length on each side of said longitudinal axis, said side surfaces on each side of said longitudinal axis extending at an obtuse angle $\gamma$ to each other, a shorter said side surface on each side of said longitudinal axis extending at an angle $\alpha$ of between 20° and 50° to said longitudinal axis, a longer said side surface on each side of said longitudinal axis extending at an angle $\beta$ of between 10° and 30° to said longitudinal axis, a first end surface extending perpendicular to said longitudinal axis and connected to said shorter side surfaces, a second end surface extending perpendicular to said longitudinal axis and connected to said longer side surfaces; and a clamping device for releasably mounting said plate in the sliding gate valve, said clamping device comprising a frame, at least four clamping elements pivotally mounted in said frame and defining clamping surfaces that, in a clamped state, contact respective of said side surfaces of said plate over substantially entire areas of said clamping elements, and a single clamping member for moving at least two of said clamping elements toward the other of said clamping elements.

10. An assembly as claimed in claim 9, wherein said clamping elements have lengths that are somewhat smaller than lengths of respective said side surfaces, and each said clamping element engages, in said clamped state, the said respective side surface between opposite ends thereof.

11. An assembly as claimed in claim 9, wherein said clamping member is actuable automatically.

12. A clamping device for releasably mounting a refractory plate in a sliding gate valve to be employed for controlling the discharge of molten material from a vessel, said clamping device comprising:

a frame;

at least four clamping elements pivotally mounted in said frame and defining clamping surfaces operable to, in a clamped state of said clamping device, contact respective side surfaces of the refractory plate over substantially entire areas of said clamping elements; and a single clamping member for moving at least two of said clamping elements toward the other of said clamping elements.

13. A clamping device as claimed in claim 12, wherein said clamping elements have lengths to be somewhat smaller than lengths of respective side surfaces of the refractory plate, such that each said clamping element is operable to engage, in said clamped state, the respective side surface of the refractory plate between opposite ends thereof.

14. An assembly as claimed in claim 12, wherein said clamping member is actuable automatically.

* * * * *